US005496247A

United States Patent [19]

Anderson

[11] Patent Number: 5,496,247

[45] Date of Patent: Mar. 5, 1996

[54] BACK BUILDER

[76] Inventor: Martin D. Anderson, 4131 E. Superior St., Duluth, Minn. 55804

[21] Appl. No.: 310,877

[22] Filed: Sep. 22, 1994

[51] Int. Cl.[6] ..... A63B 23/02; A63B 21/068; A47C 16/04

[52] U.S. Cl. ..... 482/142; 297/423.11; 482/140; 482/95; 482/145

[58] Field of Search ..... 482/93–96, 133, 482/134, 139, 140, 142, 145, 907; 601/24; 602/19, 32; 297/187, 466, 423.11, 423.12, 423.13, 423.41, 423.1; D6/330; 606/237, 241, 242

[56] References Cited

U.S. PATENT DOCUMENTS

| | | | |
|---|---|---|---|
| 2,480,406 | 8/1949 | Forney | 297/423.11 |
| 3,669,493 | 6/1972 | Vowles | 297/423.11 |
| 4,564,237 | 1/1986 | Steifensand | 297/423.11 |
| 4,773,106 | 9/1988 | Toso et al. | 602/19 |
| 4,993,706 | 2/1991 | Wilkinson | 482/142 |
| 5,037,090 | 8/1991 | Fitzpatrick | 482/142 |
| 5,070,863 | 12/1991 | McArthur et al. | 482/134 |
| 5,251,961 | 10/1993 | Pass | 297/423.11 |
| 5,324,247 | 6/1994 | Lepley | 482/134 |

FOREIGN PATENT DOCUMENTS

| | | | |
|---|---|---|---|
| 0449588 | 7/1948 | Canada | 297/423.11 |
| 2502487 | 10/1982 | France | 297/187 |
| 8302032 | 1/1985 | Netherlands | 297/423.12 |

OTHER PUBLICATIONS

Article "Effect of Resistance Training on Lumbar Extension Strength," *The American Journal of Sports Medicine,* vol. 17, No. 5, pp. 624–629, Michael L. Pollock, Ph.D., et al.

Article "Back in Shape," date and author unknown.

Article "New Approch to Low Back Evaluation and Training," *Central Florida Physician,* Michael L. Pollock, PhD., et al., Jul. 1989.

Advertisement "Spinal Rehabilitation (Part 1)—Measuring True Functional Ability in Clinical Practice," Michael N. Fulton, M.D., F.A.A.O.S., date unknown.

Advertisement "Spinal Rehabilitation (Part 2)—The Requirement for Specific Exercise in Clinical Practice," Michael N. Fulton, M.D., F.A.A.O.S., date unknown.

Paper entitled "A Rational Approach to the Treatment of Low Back Pain," date and author unknown.

Paper entitled "Spinal Care in the 1990's," Brian W. Nelson, M.D., Oct. 1992.

Paper entitled "The Clinical Effects of Intensive, Specific Exercise on Chronic Low–Back Pain: A controlled study of 896 consecutive Patients with One Year Follow–Up," Brian W. Nelson, M.D. et al., date unknown.

*Primary Examiner*—Richard J. Apley
*Assistant Examiner*—Victor K. Hwang
*Attorney, Agent, or Firm*—Palmatier, Sjoquist & Helget

[57] ABSTRACT

An exercise bench for strengthening the muscles of the lower back, having a seat mounted to an inclined beam and a knee brace mounted to the beam at a position spaced downwardly from the seat, and a first restraining belt affixed proximate the seat, and a second restraining belt affixed proximate the knee brace.

16 Claims, 3 Drawing Sheets

BACK BUILDER

BACKGROUND OF THE INVENTION

The present invention relates to apparatus for developing and strengthening the muscles of the back; more particularly, the invention relates to a device for strengthening the erector spinae and quadratus lumbarum muscles. In order to properly strengthen the lumbar extensor muscles it has been scientifically shown that isolation of these muscles during exercise is necessary to produce a functional increase in their strength.

Isolation of the spinal erector muscles is accomplished by isolating the lumbar spine, which may be done by anchoring the pelvis so that no pelvic movement is possible. Once this is done, the objective is to rotate the torso upward in relation to the pelvis, which is restrained, causing a contraction of the spinal erector muscles. This isolation of lumbar function from pelvic function is very important in producing a productive exercise for the spinal erector muscles.

A machine has been developed for isolating, testing and exercising the muscles of the lumbar spine, by MedX Corporation of Ocala, Fla., and research conducted with this machine has established that a specific exercise for lumbar muscles will increase strengths to an enormous degree as a result of a once-a-week training program conducted for a period of 10–12 weeks. This machine operates by anchoring the patient's thigh while in a seated position on the machine, providing a restraint against rearward pelvic movement during the exercise, and a knee restraint to prevent upward knee movement during the exercise. The feet are placed in a position so as to receive a force imposed against the bottom of the feet. This force is transmitted to the knee ends of the femurs by the lower legs and will produce a resultant force in two directions; approximately 70% of the force will drive the femurs toward the rear, thus pushing the pelvic/hip sockets to the rear; while an equal force will push the knee ends of the femurs upwards, which upward movement is prevented by the knee pads. Thus, the region above the patient's upper thighs becomes a fulcrum which redirects the upward force on the knees to a downward force on the pelvic/hip sockets, and the resultant force pushes the pelvis toward the rear and downwards. The testing results from using this machine have been reported in an article entitled "Spinal Rehabilitation," Michael N. Fulton, M.D., published in 1993.

Isolation of the spinal erector muscles may also be accomplished by tilting the patient's torso forward while the patient is in a kneeling or sitting position at an angle of 30° relative to the horizontal, with the forward movement of the patient's body being restrained by pads engaged against the knees. The patient's pelvis is isolated by a thigh restraint applied over the upper thigh region of the leg and a waist restraint is placed about the patient's waist to prevent the patient's pelvis from rotating during the exercise. The combination of these restraints provides isolation of the lumbar spinal movement and prevents pelvic rotation around the hip sockets, all of which causes the spinal erector muscles to become exercised when the patient bends forwardly and rearwardly about these restraints.

SUMMARY OF THE INVENTION

The invention comprises an inclined support for accommodating the user in a seated position, wherein the seat is sloped at approximately a 30° angle from the horizontal. The inclined seating surface extends for a distance sufficient to provide a comfortable seating surface for the user and adjacent the seating surface there is provided an opening for placing the user's legs generally beneath the seating surface. Adjacent the opening there is provided a horizontal knee pad for supportable contact against the user's knees, such that when the user is seated on the surface his knees are in supportable contact against the knee pad, and the user's lower leg extremities are positioned beneath the seating surface. A first adjustable hold-down strap is affixed to a support frame beneath the seating surface and is extendable over the user's upper leg portion, proximate his torso, and is adjustable to be secured against the user's upper leg so as to hold the user in a seated position on the inclined surface. A second strap has its respective ends affixed to the frame proximate the knee pad and is adjustably positionable about the lower back of the user, so as to confine the lower back in a forwardly direction toward the knee pad and to limit the user's freedom of motion so that flexure of the back is required in order for the user to sit upright on the inclined seating surface.

It is a principal object of the present invention to provide a device for properly constraining a patient's body in a position so as to maximize the benefit of exercise treatment of the lower back muscles.

It is another object of the present invention to provide a training device to aid in the strengthening of the lower back muscles.

It is a further object of the present invention to provide an inclined seating surface and knee pads so as to confine the user in an inclined seating position, in combination with a belt arrangement for holding the user on the seating surface, and a belt arrangement for constraining and limiting the position of the lower back.

The foregoing and other objects and advantages of the invention will become apparent from the following specification and claims, and with reference to the appended drawings.

DESCRIPTION OF THE PREFERRED EMBODIMENT

Figure 1:
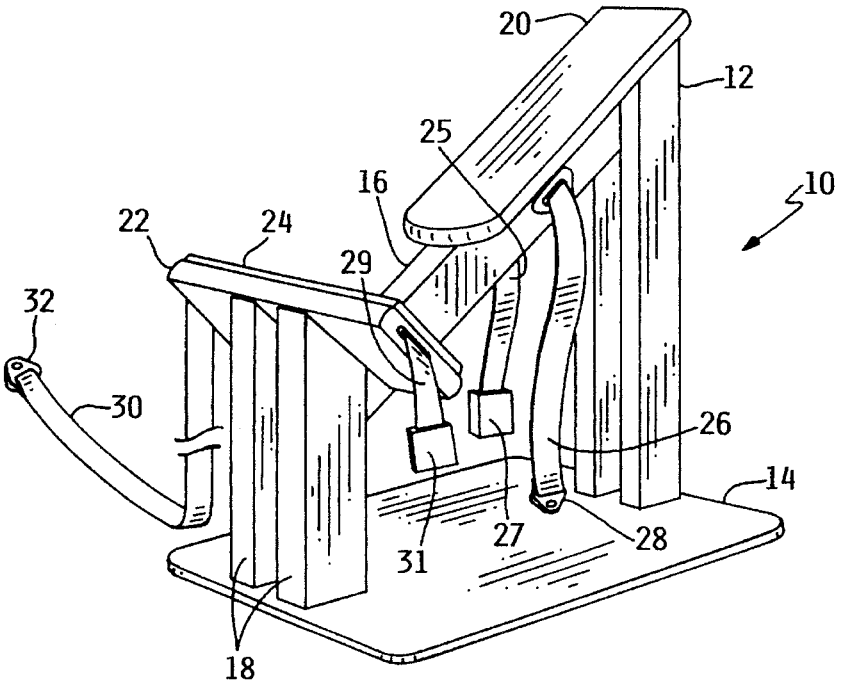
FIG. 1 shows an isometric view of a first embodiment of the invention.

Referring first to FIG. 1, there is shown an exercise device 10 suitable for accommodating a user in a seated position. Exercise device 10 has one or more vertical support posts 12 mounted to a base 14 and supporting the rear end of an inclined beam 16. The front end of inclined beam 16 is supported by one or more vertical support posts 18.

Inclined beam 16 is supported at an angle of approximately 30° relative to the horizontal and at an elevated position above base 14. The angle of inclination of beam 16 is chosen to increase the muscular activity required for moving the user's upper body from a forward-leaning position to an upright position. An angle of 30° relative to the horizontal is believed to be optimal for this purpose, although an angle ranging from 20° to 40°, relative to the horizontal, would also appear to provide some effective muscular exercising. However, the empirical testing which has been conducted with the invention suggests that the 30° angle of inclination is preferable.

A-seat member 20 is affixed to the top rear surface of inclined beam 16. A knee brace 22 is supported atop vertical support posts 18 and is generally inclined at an angle proximately 120° relative to the angle of incline of beam 16. Knee brace 22 may have a resilient surface 24 to support against the user's knees. Knee brace 22 is preferably inclined at an angle of approximately 30° relative to the horizontal, thereby permitting a comfortable support to permit the user's lower legs to be positioned beneath seat member 20.

An adjustable belt 25, 26 is affixed to respective outer edges of inclined beam 16, or to the undersurface of seat member 20, with belt section 25 extending to one side of beam 16 and belt section 26 extending to the other side of beam 16. A buckle 27 is affixed to an end of belt section 25 and a clasp 28 is affixed to the end of belt section 26. Belt 25, 26 may be adjustable according to any of a number of techniques known in the art and may be made from conventional material usually associated with safety belts and the like. A second belt 29, 30 is affixed proximate the ends of knee brace 22, belt section 29 having a buckle 31 affixed to one end, and belt section 30 having a clasp 32 affixed to one end. Belt 29, 30 is preferably an adjustable belt made according to a number of well-known techniques for the manufacture of safety belts and the like. It is also possible to utilize a one-piece belt for the purposes of this invention, wherein the respective ends of the one-piece belt are attached as shown in the figures. In this case, the belt loop formed by the one-piece belt should be sufficiently large so as to permit the entry and egress of the user; and the belt loop should have an adjustable buckle or tensioning device so as to permit the loop to be made longer or shorter as the needs of the individual user demand.

Figure 2:
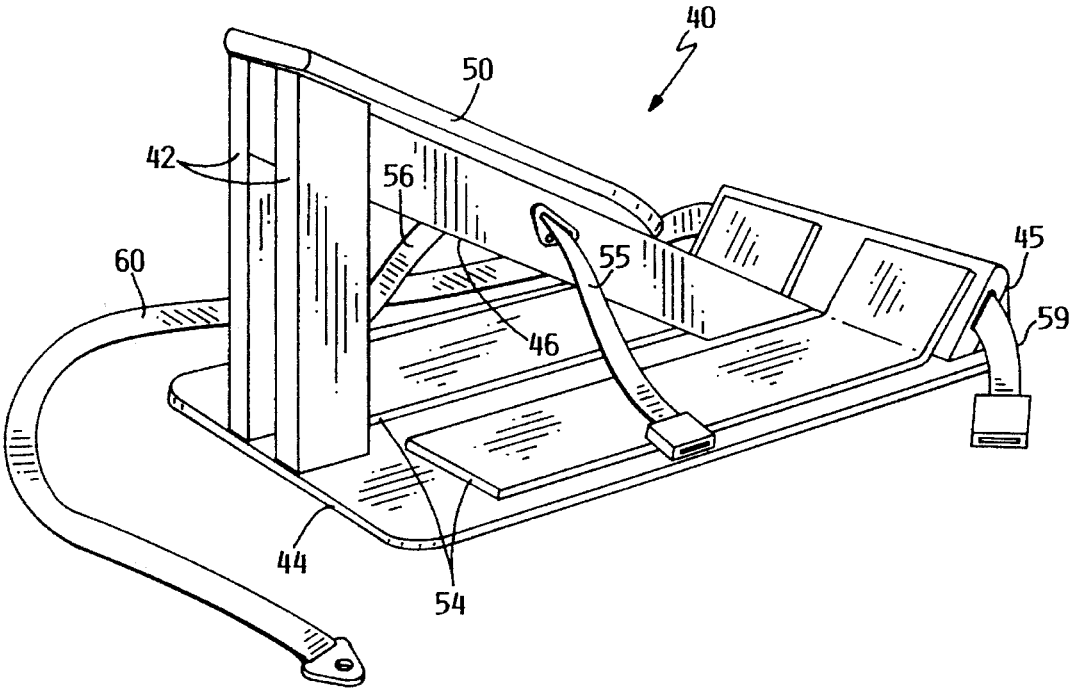
FIG. 2 shows an isometric view of a second embodiment of the invention.

FIG. 2 shows an isometric view of a second embodiment of the invention; namely, a kneeling exercise device 40, a pair of vertical posts 42 extend upwardly from a base 44 and support one end of an inclined beam 46. The lower end of inclined beam 46 is affixed to base 44, and the forward end 45 of base 44 is curved upwardly to serve as a knee brace. A pair of resilient foam pads 54 are affixed to the base 44 and extend upwardly over the forward end 45. An inclined seat member 50 is affixed over the top surface of inclined beam 46 in a manner similar to that described in connection with FIG. 1. A first belt 55, 56 is affixed to respective side edges of beam 46 in a manner similar to that described with reference to FIG. 1. A second belt 59, 60 is affixed proximate the forward end 45 of base 44. Belts 55, 56 and 59, 60 are conventional safety belts which are adjustable according to techniques which are well known in the art.

Figure 3:
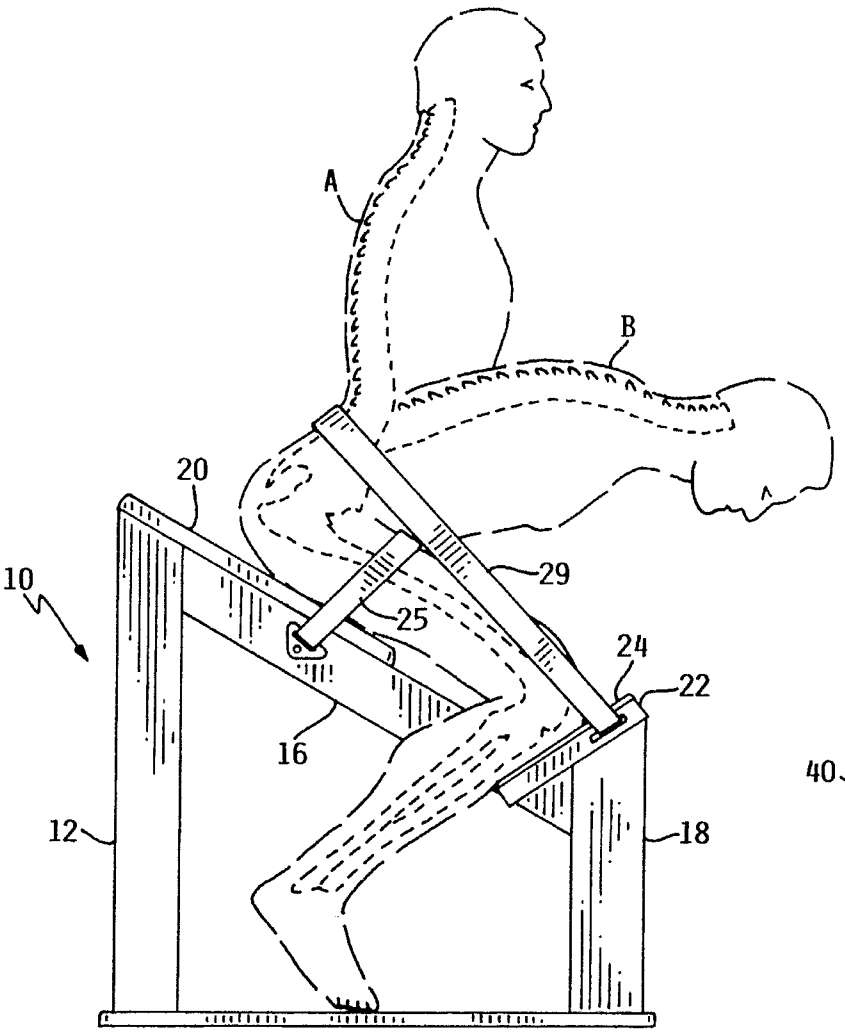
FIG. 3 shows a side elevation view of the embodiment of FIG. 1, showing the user's exercise positions.

FIG. 3 shows the exercise device 10 in side elevation view with a person seated in the proper position astride the inclined beam 16. The person's knees are engaged against resilient surface 24, and belt 25 is secured about the person's legs proximate the torso. Belt 29, 30 is secured about the person's waist at a point just above the pelvis. The user's position shown as "A" is the first exercise position which is approximately an upright seated position. The person's position "B" shows the second exercise position wherein the person's upper body has been forwardly bent toward knee brace 22.

Figure 4:
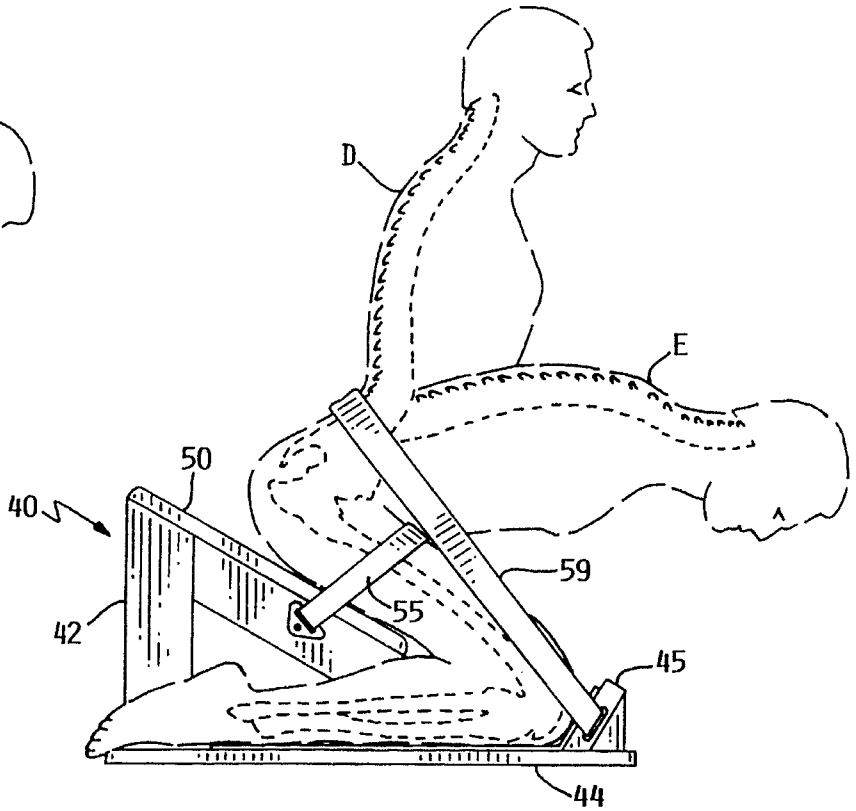
FIG. 4 shows a side elevation view of the embodiment of FIG. 2, showing the user's exercise positions.

FIG. 4 shows a side elevation view of the kneeling exercise device 40, illustrating the exercise positions of a user. Belts 55, 56 and 59, 60 are adjustably affixed about the person's upper leg and waist in the manner as illustrated in FIG. 4, and the upright position "D" illustrates a first exercise position, and the forwardly-leaning position "E" illustrates the second exercise position.

In the examples shown in FIGS. 3 and 4, the person's spinal cord is shown in dotted outline, illustrating the spinal cord curvatures which are possible in utilizing the invention. In each case, the straightening of the person's body from the forward position will result in the spinal cord becoming curved about the contact point with the belt. This curvature, in the restraint of the belt, forces the person's lower back muscles to become exercised in moving the body from a forward position to an erect position.

Figure 5:
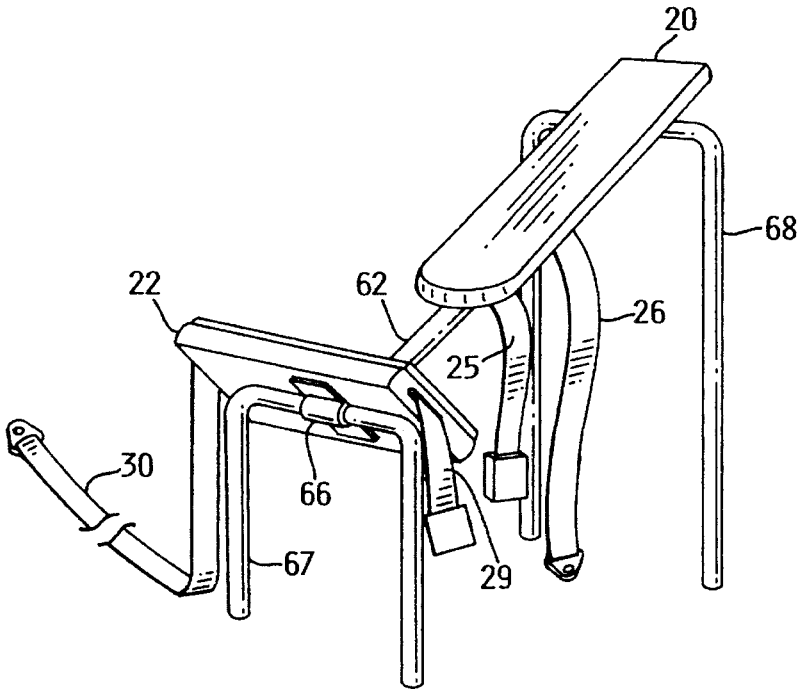
FIG. 5 shows a further embodiment of the invention.

FIG. 5 shows a variant of the embodiment of FIG. 1, illustrating a slightly different construction. In FIG. 5, an inclined seat 20 may be affixed to a tubular member 62 which is affixed at its rear end to a U-shaped tubular frame 68 and affixed at its front end to knee brace 22. A second U-shaped tubular frame 67 is affixed to knee brace 22 by means of a support bracket 66, or equivalent mounting structure. An adjustable belt 29, 30 may be affixed to knee brace 22, and an adjustable belt 25, 26 may be affixed either to inclined tubular member 62 or to the underside of seat 20. Of course, the tubular members and the respective attachments illustrated in FIG. 5 may be constructed so as to be pivotal about one or more axes. For example, the tubular frame 67 and/or the tubular frame 68 may be constructed so as to be pivotal about their respective horizontal members, to thereby permit the apparatus to become collapsed for storage in a more compact form. Further, the attachment of tubular member 67 and/or the attachment of tubular member 68 may be a removable attachment to permit the apparatus to be partially disassembled for storage. Finally, it is also possible to construct a pivotal connection for the respective U-shaped members and for the knee brace 22, whereby each of these members may be pivotal about a vertical axis or an axis normal to tubular member 62 to create a narrow assembly which may be conveniently sized for storage.

Figure 6:
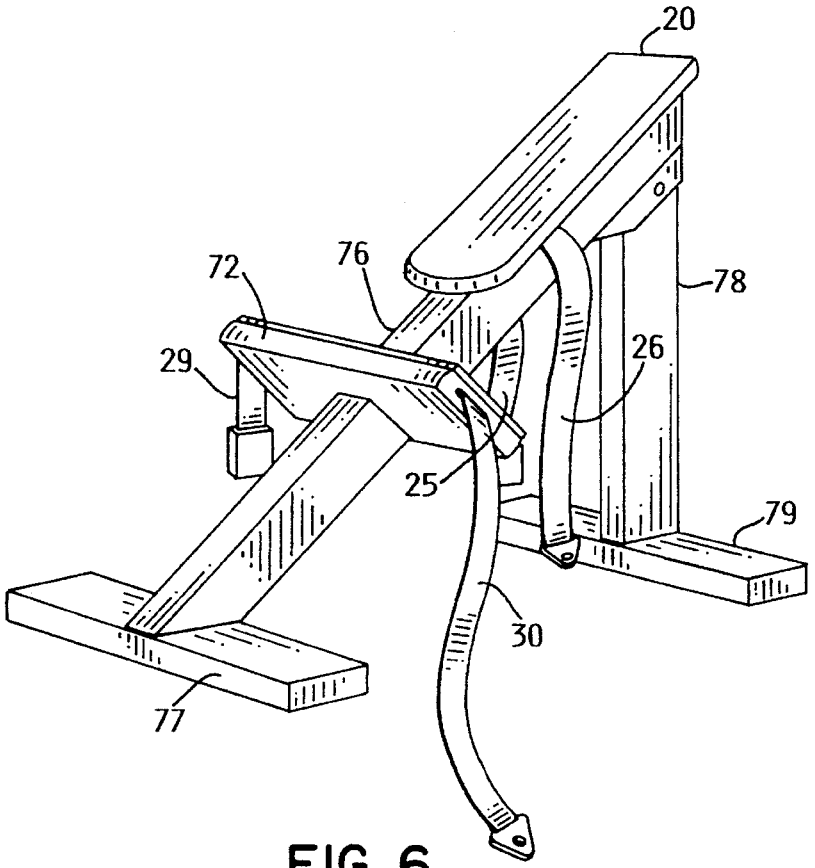
FIG. 6 shows a further embodiment of the invention.

FIG. 6 shows a further alternative construction for the invention wherein the components may be made from either tubular materials or other types of materials. In the embodiment shown in FIG. 6, a rear support post 78 supports an inclined beam 76 at an angle of approximately 30° relative to the horizontal. A front foot 77 is affixed to the lower end of inclined beam 76 and a rear foot 79 is affixed to support post 78, to provide stability for mounting the apparatus. A knee brace 72 is affixed to inclined beam 76 at the relative angle and position described hereinbefore. Of course, the respective support posts 78 and front and rear feet 77, 79 can be made so as to be detachable or hinged in order that the apparatus can be organized into a smaller form factor for storage purposes.

In operation, the user adopts a seated position as illustrated in either FIGS. 3 or 4 and attaches the respective belts as shown in the figures. The user then tightens the belt to secure the upper leg region of his body against the seat and tightens the waist belt to urge the torso forwardly toward the knee brace. The user may then undertake a number of repetitive motions as shown in positions "A" and "B" or "D" and "E" to exercise and strengthen the erector spinae and quadratus lumbarum extensor muscles.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. An exercise bench apparatus for strengthening the muscles of the lower back by confining a portion of the user's body in a relatively immobile position, while permitting the user to freely move between an upright seated position and a forwardly leaning position, comprising:

a) a beam fixedly mounted at a position which is inclined at substantially 30° relative to the horizontal;

b) a seat member affixed to said beam;

c) a knee brace mounted to said beam and at a position spaced away from said seat and proximate a lower end of said beam;

d) a first restraining means for immobilizing the upper portion of a user's legs relative to said seat; said first restraining means comprising a first elongate adjustable belt affixed proximate said seat member whereby said belt may be adjustably tightened about the user's upper leg portions; and e) a second restraining means for restraining the user's body from movement away from said knee brace; said second restraining means comprising a second elongate adjustable belt affixed proximate said knee brace, whereby said belt may be adjustably tightened about the user's lower back portion and whereby the user's knees are held against said knee brace and pelvic rotation about the hip sockets is restrained.

2. The apparatus of claim 1, further comprising a resilient pad affixed to said knee brace and positioned to contact the user's knees.

3. The apparatus of claim 2, wherein said seat member comprises an elongate substantially planar surface of predetermined width, affixed proximate an upper end of said beam and extending downwardly along said beam.

4. The apparatus of claim 3, further comprising a base affixed to said beam.

5. The apparatus of claim 4, wherein said base further comprises an upturned surface which comprises said knee brace.

6. The apparatus of claim 5, further comprising at least one support member affixed between said base and said beam, proximate an upper end of said beam.

7. The apparatus of claim 3, further comprising a first support member affixed to said beam proximate an upper end of said beam and a second support member affixed to said beam proximate a lower end of said beam.

8. The apparatus of claim 7, further comprising a base affixed beneath said first and second support members.

9. An exercise bench apparatus for strengthening the muscles of the lower back, comprising:

a) A support member having an upper end adapted for mounting to and affixing an elongate beam at an inclined position relative to the horizontal;

b) said elongate beam having a first end affixed to said support member upper end, and having a second end downwardly inclined therefrom;

c) a seat member affixed to said elongate beam proximate said first end;

d) a knee brace affixed to said elongate beam proximate said second end;

e) a first adjustable restraint means positionable along said inclined beam proximate said seat member; whereby the upper leg may be confined against said seat member; and f) a second adjustable restraint means positionable along said inclined beam proximate said knee brace and adjustably extensible upwardly toward said seat member; whereby the lower back may be restrained from movement away from said knee brace and pelvic rotation about the hip sockets is restrained.

10. The apparatus of claim 9, further comprising a lower support member having an upper end affixed to said elongate beam proximate said knee brace.

11. The apparatus of claim 10, further comprising a resilient pad affixed to said knee brace.

12. The apparatus of claim 11, wherein said first and second adjustable restraint means each comprise an adjustable belt.

13. The apparatus of claim 12, wherein said support member and said lower support member each comprise a U-shaped tubular member.

14. The apparatus of claim 9, wherein said elongate beam is affixed at an inclined angle, relative to the horizontal, of between 20° and 40°.

15. The apparatus of claim 14, wherein said inclined angle is substantially 30°.

16. The apparatus of claim 15, wherein said knee brace is inclined at an angle of approximately 30° relative to the horizontal.

* * * * *